US006109715A

United States Patent [19]

Masaki

[11] Patent Number: 6,109,715

[45] **Date of Patent: *Aug. 29, 2000**

[54] INKJET PRINTER

[75] Inventor: Kenji Masaki, Nagaokakyo, Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/989,323

[22] Filed: Dec. 11, 1997

[30] Foreign Application Priority Data

Dec. 12, 1996 [JP] Japan ..... 8-332325

[51] Int. Cl.[7] ..... B41J 29/38

[52] U.S. Cl. ..... 347/11

[58] Field of Search ..... 347/11, 70, 46, 347/68, 69, 71, 72

[56] References Cited

U.S. PATENT DOCUMENTS

| | | | |
|---|---|---|---|
| 4,369,455 | 1/1983 | McConica et al. | 346/140 R |
| 4,434,430 | 2/1984 | Koto | 347/70 |
| 4,503,444 | 3/1985 | Tacklind | 346/140 R |
| 5,208,605 | 5/1993 | Drake | 346/1.1 |
| 5,412,410 | 5/1995 | Rezanka | 347/15 |
| 5,644,341 | 7/1997 | Fujii et al. | 347/11 |

FOREIGN PATENT DOCUMENTS 0437062 7/1991 European Pat. Off. .

*Primary Examiner*—John Barlow
*Assistant Examiner*—Charles W. Stewart, Jr.
*Attorney, Agent, or Firm*—Sidley & Austin

[57] ABSTRACT

A control system for an inkjet printer to deliver a drive voltage to a piezoelectric element to discharge an ink drop and to reduce the effects of post-discharge vibrations propagated through an ink reservoir within a printing head of the inkjet printer. The control system can reduce the effects of post-discharge vibrations by delivering a secondary pulse to the piezoelectric element following delivery of the drive voltage and/or tailoring the leading and trailing edges of the driving voltage.

33 Claims, 5 Drawing Sheets

INKJET PRINTER

FIELD OF THE INVENTION

The present invention relates to inkjet printers, and in particular, to an inkjet printer capable of discharging ink drops of a plurality of different drop diameters and having a control mechanism to prevent internalized ink vibrations following an ink discharge.

BACKGROUND OF THE INVENTION

A piezoelectric element may be used in a conventional printing head of an inkjet printer to effect a discharge of an ink drop in a printing operation. In a printing head of this type, the piezoelectric element is deformed by application of a drive voltage. A piezoelectric element deformation applies pressure to a reservoir of ink within an ink storing chamber (or ink channel) of the printing head, thus causing at least a portion of the reservoir to be discharged from a nozzle in communication with such reservoir. The discharged ink drop adheres to a printing medium to form an ink dot, wherein a plurality of such dots form an image.

As mentioned, the piezoelectric element is driven by an applied pulse voltage. After application of the pulse voltage and discharge of an ink drop from the nozzle, a secondary and unnecessary vibration is generated within that ink remaining within the portions of the ink channel and/or nozzle in contact with the piezoelectric element. Moreover, when an ink drop of a large diameter is discharged, since the volume of the ink drop is greater than the volume of an ink drop of a small diameter, the vibration of the ink inside the ink channel and/or the nozzle is greater than that in the case where the ink drop of a small diameter is discharged.

In a printing head employing a piezoelectric element, a next ink drop should be discharged only after the vibration of the ink settles. This practice serves to ensure the accuracy of the next ink drop diameter. For this reason, if an ink vibration is great, a longer period must necessarily lapse before the next ink drop is discharged, thus such delay contributes to a reduction in overall printing speed.

SUMMARY OF THE INVENTION

The present invention is directed to an inkjet printer. According to one embodiment of the present invention, an inkjet printer is disclosed that includes a printing head and a controller. The printing head includes an ink channel for storing ink, a nozzle in fluid communication with said ink channel, and a piezoelectric element, corresponding with the ink channel, to effect a discharge of the ink through the nozzle. The controller controls the printing head, such control including causing application of a first voltage to the piezoelectric element for discharging an ink drop and causing application of a second voltage to the piezoelectric element for preventing a post-discharge vibration.

In another embodiment of the inkjet printer, the printing head includes a first head section and a second head section, wherein the first head section discharges an ink drop having a size within a first size range and the second head section discharges an ink drop within a first size range, where the first size range differs from the second size range.

The object of the present invention is to provide an inkjet printer having a control mechanism to prevent internalized ink vibrations following an ink discharge.

Other objects and advantages of the present invention will be apparent to those of ordinary skill in the art having reference to the following specification together with the drawings.

BRIEF DESCRIPTION OF THE DRAWINGS

Referring now to the drawings in which like reference numerals and letters indicate corresponding elements throughout the several views, if applicable.

DETAILED DESCRIPTION OF THE PREFERRED EMBODIMENTS

An inkjet printer according to an embodiment of the present invention will be described below with reference to the drawings.

Figure 1:
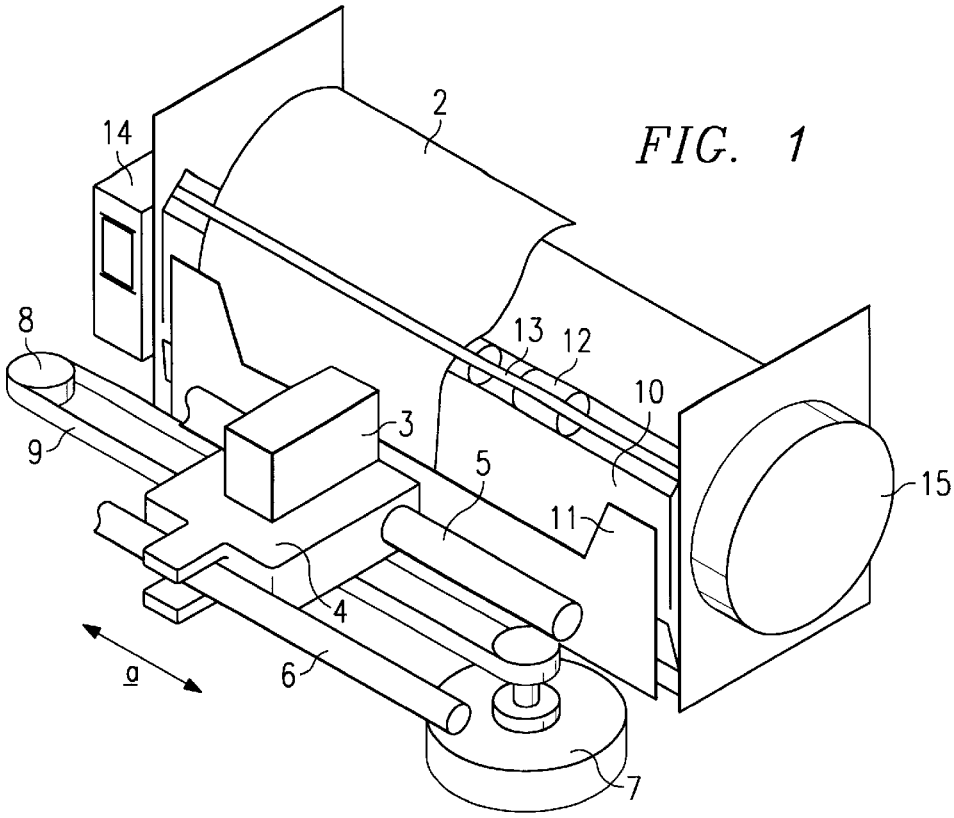
FIG. 1 is a perspective view of an inkjet printer 1 according to an embodiment of the present invention.

FIG. 1 is a perspective view schematically showing the construction of an inkjet printer 1 according to an embodiment of the present invention. The inkjet printer 1 includes an inkjet type printing head 3; a carriage 4 for holding the printing head 3; shafts 5 and 6 for reciprocating the carriage 4 in parallel Keith a printing surface of a printing medium 2; a driving motor 7 for reciprocating the carriage 4 along the shafts 5 and 6; a timing belt 9 for transforming the rotation of the driving motor 7 into a reciprocating motion of the carriage 4; and an idling pulley 8. The inkjet printer 1 accommodates a print medium 2, or a printing sheet, wherein a print sheet 2 may be a paper sheet, a thin, plastic plate (film), or the like.

The carriage 4 is reciprocated by a combination of the driving motor 7, the idling pulley 8, and the timing belt 9 in the direction a, and the printing head 3 mounted to the carriage 4 successively prints images one line at a time. Every time the printing of one line is completed, the printing sheet 2 is fed in its lengthwise direction, thereby executing printing of one frame.

The inkjet printer 1 also includes a platen which concurrently serves as a guide plate for guiding the printing sheet 2 along a transfer path; a sheet pressing plate 11 for pressing the printing sheet 2 against the platen 10 to prevent lifting; a discharging roller 12 for discharging the printing sheet 2; a spur roller 13; a recovering system 14 for recovering a defective ink discharge of the printing head 3; and a paper feeding knob 15 for manually feeding the printing sheet 2.

A printing sheet 2 is fed either manually or by a paper feeding unit (not shown), such as a cut sheet feeder, into a printing section where the printing head 3 and the platen 10 face each other. In this stage, the amount of rotation of a paper feeding roller (not shown) controls the feeding of the printing sheet 2 into the printing section.

Figure 2:
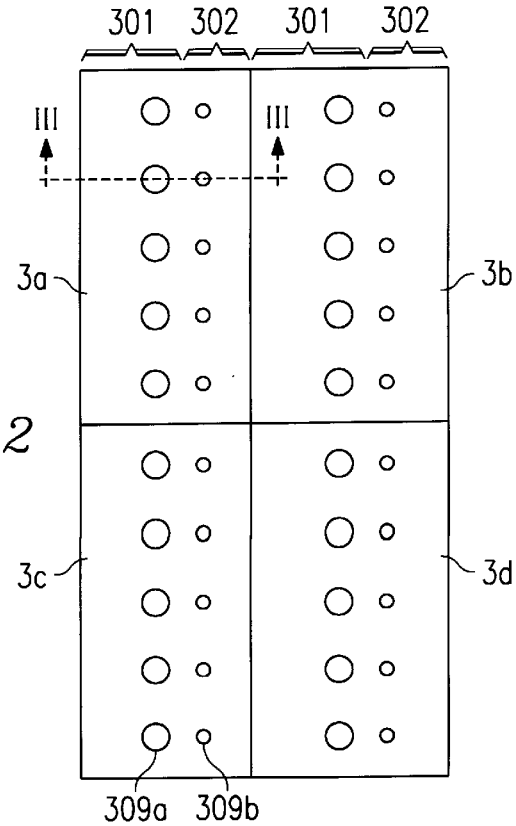
FIG. 2 is a plan view illustrating a printing head of the present invention.
Figure 3:
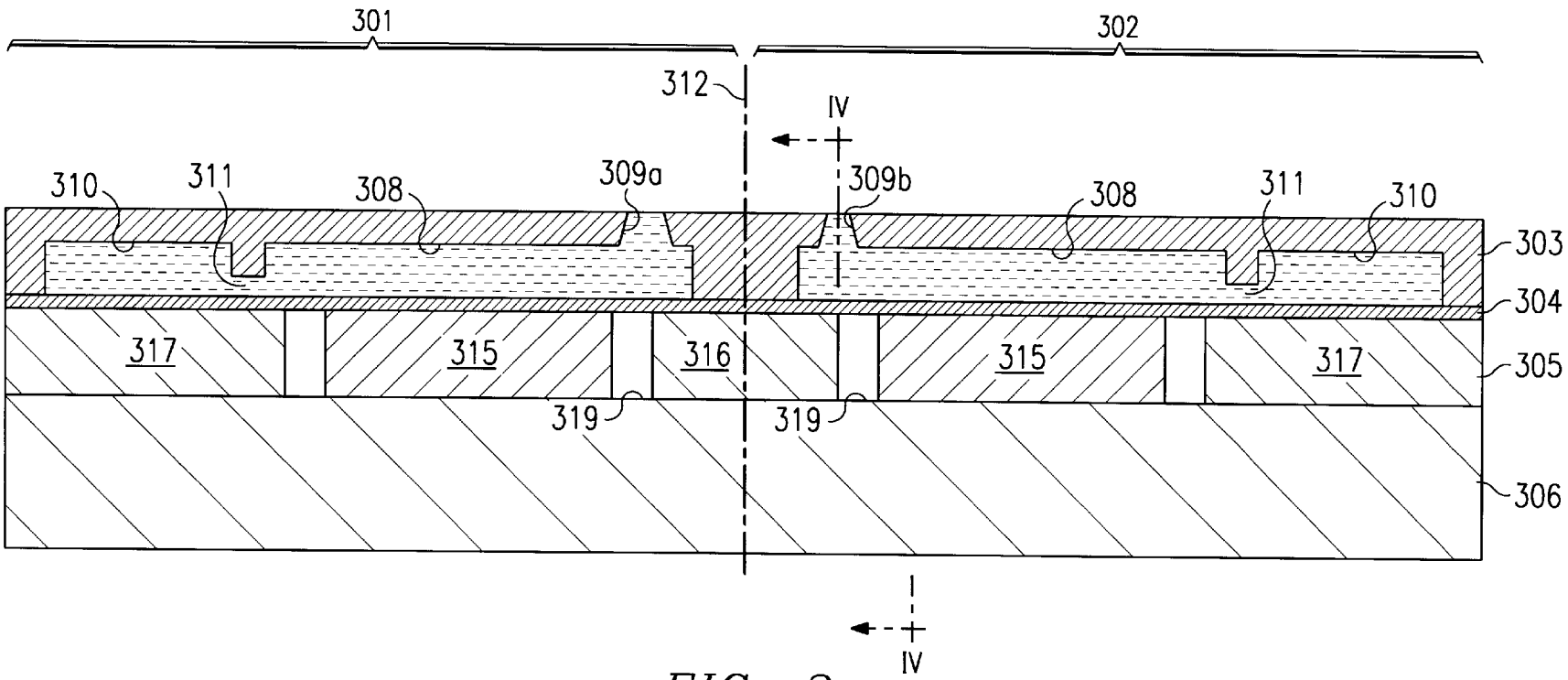
FIG. 3 is a sectional view taken along line III—III of the printing head 3 of FIG. 2.
Figure 4:
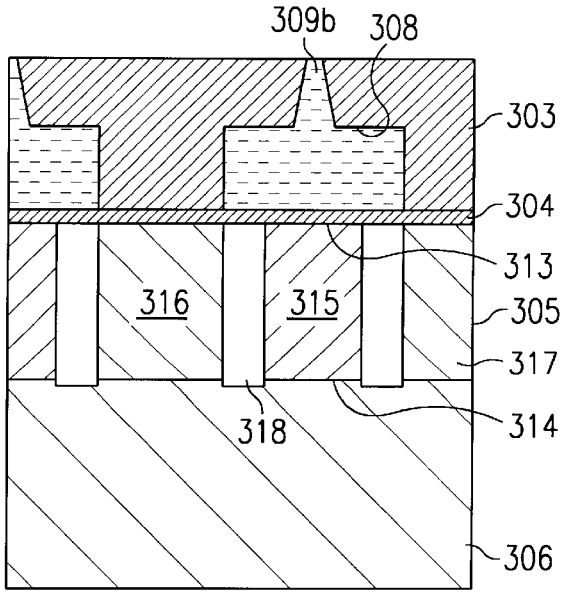
FIG. 4 is a sectional view taken along line IV—IV of the printing head of FIG. 3.

FIGS. 2, 3, and 4 illustrate the printing head 3 of the present invention. Specifically, FIG. 2 is a plan view of the printing head 3, FIG. 3 is a section view taken along the line III—III of the printing head 3 of FIG. 2, and FIG. 4 is a section view taken along the line IV—IV of the printing head 3 of FIG. 3.

The printing head 3 is constructed of printing heads 3*a* through 3*d* corresponding to the ink colors of yellow (Y), magenta (M), cyan (C), and black (K), respectively. The printing heads 3*a* through 3*d* each comprise a first head section 301, which discharges an ink drop of a large diameter, and a second head section 302, which discharges an ink drop of a small diameter. The first head section 301 and second head section 302 of each printing head 3 are constructed of a channel plate 303, a bulkhead 304, a vibration plate 305, and a base plate 306 integrally stacked.

Referring to FIG. 3, the channel plate 303 is constructed of metal, synthetic resin, ceramic, or a like material. A surface of channel plate 303, which faces bulkhead 304, is finely finished by electroforming, photolithography or the like, so that a plurality of recesses are formed. These recessions form a plurality of ink channels 308 for storing ink; ink supplying chambers 310 that contain resupply ink, and ink inlets 311 that connect ink channels 308 to ink supplying chambers 310.

The ink channels 308, which face each other with interposition of the centerline 312, are elongated in a lateral direction and are arranged in parallel in a longitudinal direction. The ink supplying chambers 310 are formed on opposite sides of the centerline 34, with interposition of the ink channels 308, and are each connected to respective ink tanks (not shown). The small-diameter nozzles 309*b* and the large-diameter nozzles 309*a* are formed within the channel plate 303 and communicate with each ink channel 308 on an end opposite from ink inlets 311. It is to be noted that the nozzles 309*a* and 309*b* are convergently tapered, where the ink channel 308 side-diameter is wider than the exit diameter.

A bulkhead 304 is constructed of a thin film made of a conductive material and is fixed between the channel plate 303 and vibration plate 305. The bulkhead 304 does not prevent the deformation of the piezoelectric members 315, described in greater detail below, but yields to a deformation of the piezoelectric members 315 so as to transmit such deformation to ink channels 308.

The vibration plate 305 is fixed between the bulkhead 304 and the base plate 306. A conductive adhesive is used to join at least the vibration plate 305 and the base plate 306. The vibration plate 305 is made of a known piezoelectric material, and its upper and lower surfaces are provided with conductive metal layers (not shown). Prior to the bulkhead 304 being fixed in place, the vibration plate 305 is cut longitudinally (longitudinal grooves 318) and laterally (lateral grooves 319) in a dicing process, such that the vibration plate 305 is separated into piezoelectric members 315 corresponding to each ink channel 308; partition walls 316 positioned between adjacent piezoelectric members 315; and peripheral walls 317 which encloses these members. The dicing process serves to also divide the conductive metal layers formed on the upper and lower surfaces of vibration plate 305. The conductive metal layers on the upper surfaces of piezoelectric members 315 form a common electrode and the corresponding metal conductive layers on the lower surface form individual electrodes 314.

The base plate 306 is made of a ceramic, metal, synthetic resin or the like. On a surface of the base plate 306 which faces the vibration plate 305, a conductive lead section (not shown) is formed by a known technique of sputtering, vapor deposition or the like in correspondence with the piezoelectric elements 315 of the first head section 301 and the second head section 302. The individual electrodes 314 are electrically continued to the corresponding conductive lead section via a conductive adhesive. Each piezoelectric member 315 can be polarized by applying a high voltage across the upper common electrode 314 and the lower individual electrode at an elevated temperature.

In the preferred embodiment, as shown in FIGS. 2, 3, and 4, the diameter of the nozzle 309*a* of the first head section 301 is greater than that of the nozzle 309*b* of the second head section 302. All ink channels 308 maintain a substantially identical volume. However, the nozzle diameter, the channel volume and so forth are not limited to those in the preferred embodiment, and a variety of modifications are possible. For example, it is acceptable to discharge ink drops of large and small sizes by unifying the nozzle diameter and changing the channel volume as in a modification example as described later. It is, of course, possible to discharge ink drops of large and small sizes by making the nozzle diameter and the channel volume identical and changing the magnitude of the application voltage to a piezoelectric element 315.

When a specified voltage is applied to common electrode 313 and an individual electrode 314 according to a printing signal, as will be discussed in greater de,ail below, a corresponding piezoelectric element 315 is deformed. Deformation of a piezoelectric element 315 is transmitted to the bulkhead 304, which changes the volume of the corresponding ink channel 308 and pressurizes the ink therein. As the ink reaches a predetermined pressure, the ink is discharged from a nozzle 309*a* or 309*b* as an ink drop. Following discharge of ink from the nozzle 309*a* or 309*b*, the ink within the ink channel 308 and/or the nozzle 309*a* or 309*b* is typically subject to a post-discharge vibration, particularly when a large diameter ink drop is discharged.

In the inkjet 1 of the present invention, a secondary voltage is applied to a piezoelectric element 315 to prevent such post-discharge ink vibration.

Figure 5:
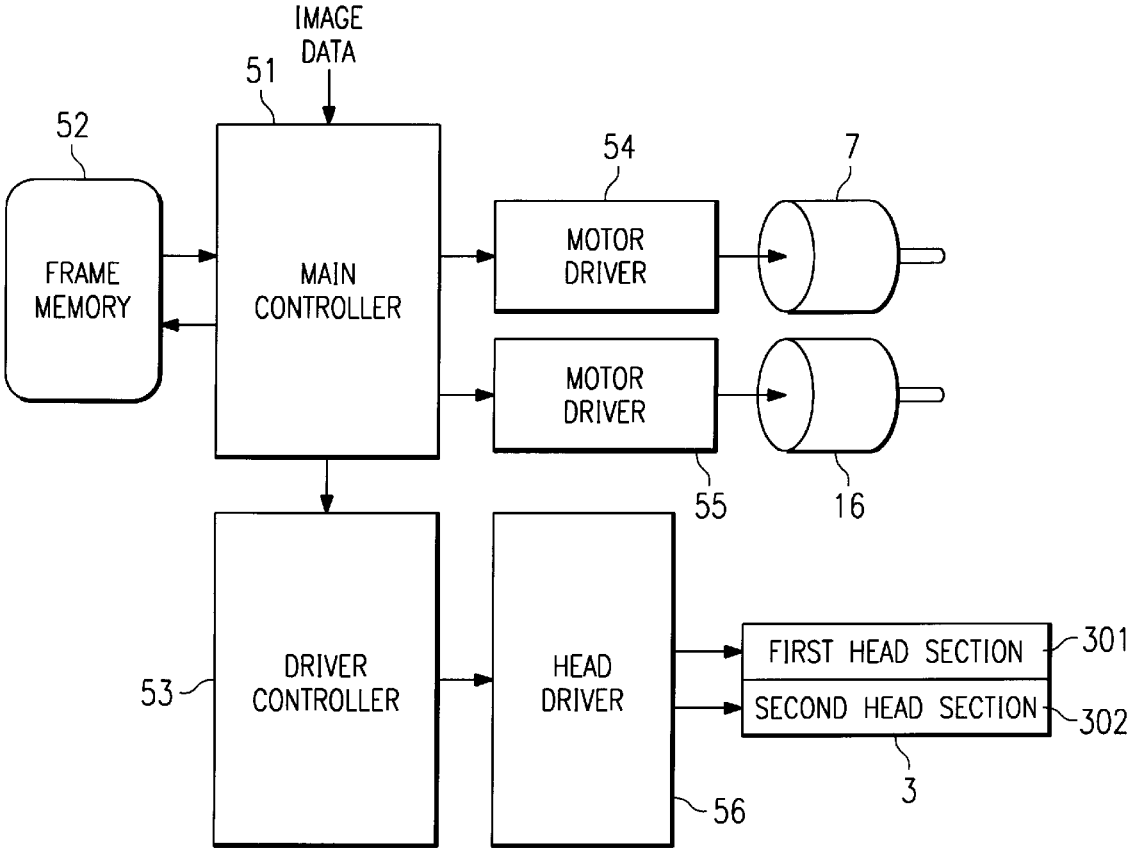
FIG. 5 is a block diagram of a control system of the inkjet printer of the present invention.

FIG. 5 illustrates a control section for the inkjet printer 1 to deliver a primary and secondary voltage to the piezoelectric elements 315 as well as control other elements during a print operation. A main controller 51 receives image data from a computer or the like and stores the data into a frame memory 52 for buffering one image frame. For printing onto a printing sheet 2, the main controller 51 drives the driving motor 7 of the carriage 4 and a paper feeding motor 16 via motor drivers 54 and 55.

Concurrently with the above driving control, the main controller 51 drives the piezoelectric elements 315 of the first head section 301 and the second head section 302 of the printing heads 3*a* through 3*d*, for each of the colors of Y, M, C, and K, via a driver controller 53 and a printing head driver 56 based on the image data read from the frame memory 52.

The drive voltage applied to the piezoelectric element 315 specifically related to the present invention will be described below with specific experimental examples enumerated.

In one embodiment of printing head 3, nozzles 309*a* have a diameter of approximately 35 $\mu$m, nozzles 309*b* have a diameter of approximately 20 $\mu$m, and ink channels 308 are substantially equal in volume. As set forth above and is evident from the relative sizes of each nozzle, nozzles 309*a* inherently provide a larger ink dot than nozzles 309*a*. For this embodiment following an ink discharge, a natural vibration cycle of the ink remaining within printing head 3 was measured. The measurement showed that the first head section 301 (nozzles 309*a*) had a vibration cycle of approximately 40 μs and the second head section 302 (nozzles 309*b*) had a vibration cycle of approximately 20 μs.

Figure 6A:
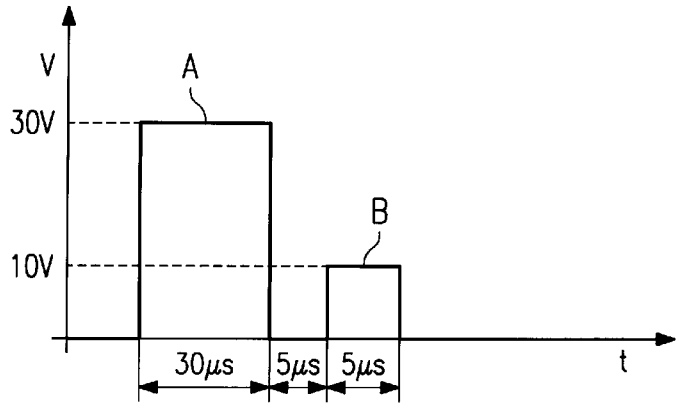
FIGS. 6(*a*) and 6(*b*) illustrate a first embodiment of a drive voltage applied to a piezoelectric element of the printing head of the present invention.

FIGS. 6(*a*) and 6(*b*) illustrate a drive voltage applied to the piezoelectric elements 315 of this embodiment of the printing head 3. More specifically, FIG. 6(*a*) illustrates a drive voltage applied to the piezoelectric elements 315 corresponding to nozzles 309*a*, while FIG. 6(*b*) illustrates a drive voltage applied to the piezoelectric elements 315 corresponding to nozzles 309*b*.

A drive voltage consisting of a main pulse A of substantially 30 V for approximately 30 μs and a sub-pulse B of substantially 10 V for approximately 5 μs is applied to the piezoelectric elements 315 corresponding to nozzles 309*a*, wherein main pulse A and sub-pulse B are separated by an interval (0 V) of approximately 5 μs. A drive voltage consisting of only a pulse C of substantially 30 V for approximately 50 μs is applied to the piezoelectric elements 315 corresponding to nozzles 309*b*. For this embodiment, the main pulse A and the pulse C correspond to a voltage applied in accordance with printing data and correspond to each pixel of an image to be printed. In other words, the main pulse A and the pulse C operate to discharge ink drops from nozzles 309*a* and 309*b*, respectively. In contrast, the sub-pulse B is a voltage applied for the purpose of preventing ink vibrations within ink channels 308. The sub-pulse B is a weak voltage and is unable to cause an ink drop to be discharged.

When the drive voltage shown in FIG. 6(*a*) is applied to the piezoelectric elements 315 corresponding to the nozzles 309*a*, the piezoelectric elements 315 enter into a state in which the next main pulse A can be applied after an interval of about 60 μs. In the case of nozzles 303*a* when only the main pulse A is applied, about 80 μs are required to stabilize the ink vibrations so as to accommodate application of a next pulse. Accordingly, the inkjet printer 1 of the present embodiment realizes an increase in printing speed of approximately 25%.

Figure 6B:
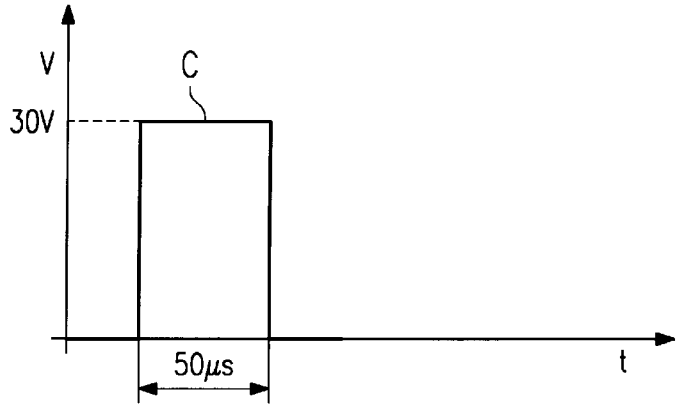

In reference to FIG. 6*b*, the applied pulse C for nozzles 309*b* is of sufficient duration and amplitude so as to be effectively identical in function to the main pulse A/sub-pulse B combination for nozzles 309*a*.

It is preferred that the time required for the fall of the sub-pulse B to the rise of the next main pulse A, for the purpose of effectively settling any vibration of the ink in regard to the drive voltage applied to the first head section 301, be equal or greater than 20 μs. It is also preferred to make the required time from the rise of the main pulse A to the rise of the sub-pulse B shorter than that required for the rise and the fall of the pulse C. If substantially achieved, the time required for settling an ink vibration becomes equal in the firs; head section 301 and the second head section 302, and therefore, the printing efficiency of the printing head 3 as a whole is improved.

It is preferred that the interval between the rise of the main pulse A and the rise of the sub-pulse B not be shorter than 20 μs. With such interval length, any ink vibration can be more effectively settled.

For another embodiment of the printing head 3, the ink channels in the first head section 301 and the ink channels of the second head section 302 have a volume ratio of 3:1 and nozzles 309*a* and 309*b* have like diameters, for example, approximately 25 μm. For this embodiment, following an ink discharge, a natural vibration cycle of the ink remaining within printing head 3 was measured. The measurement showed that the first head section 301 had a vibration cycle of approximately 40 μs and the second head section 302 had a vibration cycle of approximately 20 μs.

When the drive voltage shown in FIG. 6(*a*) is applied to the piezoelectric elements 315 corresponding to the nozzles 309*a* (large volume ink channels 308), the piezoelectric elements 315 enter into a state in which the next main pulse A can be applied after an interval of about 60 μs. In the case of the nozzles 309*a*, when only the main pulse A was applied, about 80 μs are required to stabilize the ink vibrations so as to accommodate application of a next pulses. Accordingly, the inkjet printer 1 of the present embodiment realizes an increase in printing speed of approximately 25%.

In reference to FIG. 6*b*, the applied pulse C for nozzles 309*b* is of sufficient duration and amplitude so as to be effectively identical in function to the main pulse a/sub-pulse B combination for nozzles 309*a*.

Figure 7A:
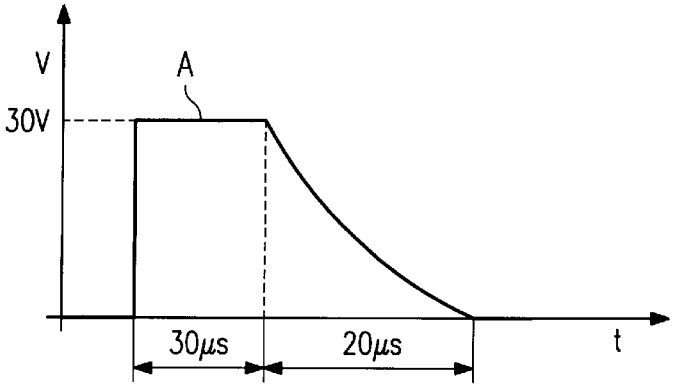
FIGS. 7(*a*) and 7(*b*) illustrate a second embodiment of a drive voltage applied to the piezoelectric element of the printing head of the present invention.

FIGS. 7(*a*) and 7(*b*) illustrate a drive voltage applied to the piezoelectric elements 315 of this embodiment of the printing head 3. More specifically, FIG. 7(*a*) illustrates a drive voltage applied to the piezoelectric elements 315 corresponding to the nozzles 309*a* (large volume ink channels 308), while FIG. 7(*b*) illustrates a drive voltage applied to the piezoelectric elements 315 corresponding to nozzles 309*b*.

A drive voltage consisting of a pulse A of substantially 30 V for approximately 30 μs and having a trailing edge taking approximately 20 μs to reach 0 V is applied to the piezoelectric elements 315 corresponding to nozzles 309*a*. Notwithstanding the specific embodiment of an approximately 20 μs trailing edge duration, the duration of the slope at the trailing edge should be greater than a half of the natural vibration cycle of the ink. A drive voltage consisting of a pulse B of substantially 30 V and approximately 50 μs is applied to the piezoelectric elements 315 corresponding to nozzles 309*b*.

When the drive voltages as described above are applied, the state in which the next pulse can be applied is achieved after an interval of about 60 μs-similar to the first embodiment-allowing the printing speed of the printer to be increased by approximately 25%.

Figure 7B:
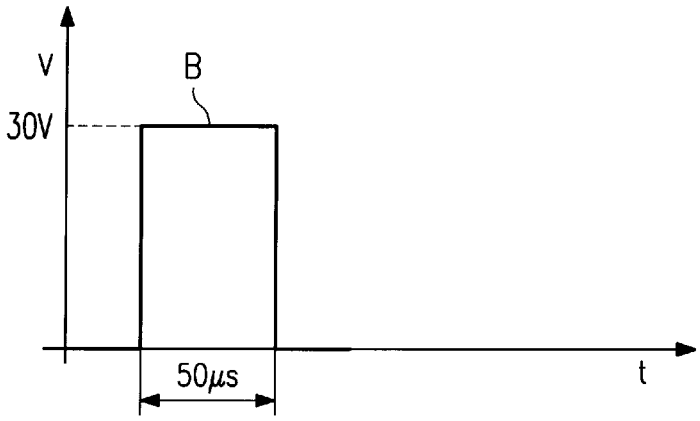

In reference to FIG. 7*b*, the applied pulse B for nozzles 309*b* is of sufficient duration and amplitude so as to be effectively identical in function to the main pulse A for nozzles 309*a*.

Figure 8A:
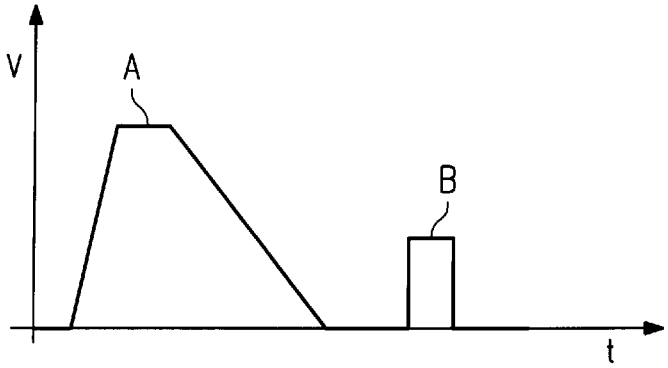
FIGS. 8(*a*) and 8(*b*) illustrate a third embodiment of a drive voltage applied to the piezoelectric element of the printing head of the present invention.
Figure 8B:
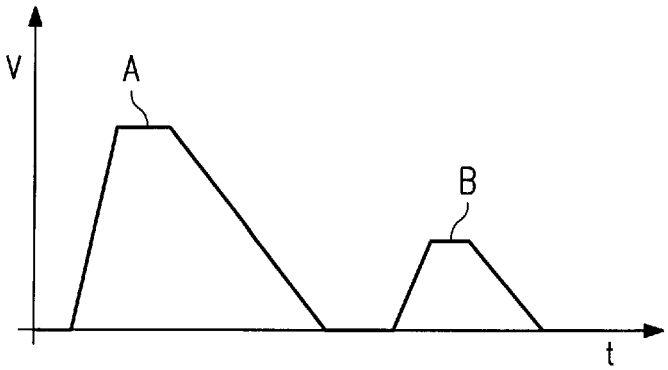

In reference to the original structural configuration, another embodiment requires gradually increasing the voltage at the leading edge of the main pulse A and further, gradually reducing the voltage at the trailing edge, as shown in FIGS. 8(*a*) and 8(*b*), the possible occurrence of an ink vibration can be more effectively prevented. In addition, by gradually varying the voltage at the leading edge and the trailing edge of the sub-pulse B, as shown in FIG. 8(*b*), an ink vibration can be more effectively settled. For this embodiment, it is preferable to make the time required for the rise of the voltage shorter than the time required for the fall.

It is preferred that the time required for the fall of the main pulse A, shown in FIGS. 8(*a*) and 8(*b*), not be shorter than one half of the natural vibration cycle of the ink inside the ink channel and/or nozzle 309*a* or 309*b*.

In an inkjet printer 1 in which the size of an ink drop to be discharged is varied according to the gradation of the image to be printed, an ink vibration can be more effectively suppressed by controlling the voltage value of a sub-pulse in accordance with the size of the ink drop to be discharged. That is, when the voltage value of the main pulse is raised to increase the diameter of an ink drop to be discharged, the voltage value of the sub-pulse is increased accordingly.

Conversely, when the voltage value of the main pulse is lowered to reduce the diameter of an ink drop to be discharged, the voltage value of the sub-pulse is reduced accordingly.

In regard to any of the embodiments set forth here, a high-speed printing can be achieved in the inkjet printer 1 having the printing head 3 of the present invention providing a plurality of nozzles 309*a* and 309*b* for enabling ink drops of different sizes to be discharged.

While the invention has been described herein relative to a number of particularized embodiments, it is understood that modifications of, and alternatives to, these embodiments, such modifications and alternatives realizing the advantages and benefits of this invention, will be apparent to those of ordinary skill in the art having reference to this specification and its drawings. It is contemplated that such modifications and alternatives are within the scope of this invention as subsequently claimed herein, and it is intended that the scope of this invention claimed herein be limited only by the broadest interpretation of the appended claims to which the inventors are legally entitled.

What is claimed is:

1. An inkjet printer comprising:

a printing head adapted to discharge ink drops within a first size range and a second size range, such first size range being different from said second size range, including:

at least one ink channel for storing ink;

at least one nozzle in fluid communication with said at least one ink channel; and at least one piezoelectric element corresponding to said at least one ink channel to effect a discharge of ink through said is nozzle; and a controller to control said printing head to effect a discharge of ink drops in said first size range and said second size range, such control including (i) application of a primary voltage to said at least one piezoelectric element to discharge an ink drop in the first size range and application of a secondary voltage to said at least one piezoelectric element to prevent a post-discharge vibration in said at least one ink channel as a consequence of an applied primary voltage and (ii) application of a primary voltage to said at least one piezoelectric element to discharge an ink drop in the second size range and preventing application of a corresponding secondary voltage, wherein an ink drop of said first size range has a greater recorded diameter than an ink drop of said second size range.

2. An inkjet printer as claimed in claim 1, wherein, for formation of ink drops in said first size range, said secondary voltage is a pulse voltage to be applied after an applied primary voltage.

3. An inkjet printer as claimed in claim 2, wherein, for formation of ink drops in said first size range, said secondary voltage is applied after a lapse of at least 20 $\mu$s after of an applied primary voltage.

4. An inkjet printer as claimed in claim 1, wherein, for formation of ink drops in said first size range, said primary voltage is provided by a main pulse, and said secondary voltage is provided by a sub-pulse applied after an applied main pulse.

5. An inkjet printer as claimed in claim 4, wherein a time required for a fall of said main pulse is longer than a time required for a rise of said main pulse.

6. An inkjet printer as claimed in claim 4, wherein a time required for a fall of said main pulse is at least equal to one-half of a natural vibration cycle of ink in said ink cavity.

7. An inkjet printer as claimed in claim 4, wherein said sub-pulse has a small voltage value which does not induce an ink discharge.

8. An inkjet printer as claimed in claim 4, wherein said sub-pulse has a voltage value based on a size of an ink drop discharged by the main pulse.

9. An inkjet printer as claimed in claim 1, wherein, for formation of ink drops in said first size range, said secondary voltage is applied as a continuation of an applied primary voltage, and said secondary voltage value gradually decreases over a prescribed time.

10. An inkjet printer comprising:

a printing head, including:

a first head section, having a first nozzle, to discharge an ink drop, said ink drop having a size within a first size range; and a second head section, having a second nozzle, to discharge an ink drop, said ink drop having a size within a second size range, wherein said second size range differs from said first size range, and a controller to control said printing head, including to effect an application of a first pulse voltage to said first head section and said second head section, for discharging respective ink drops therefrom, and to effect an application of a second voltage to only said first head section for preventing a post-discharge vibration due to an applied first voltage.

11. An inkjet printer as claimed in claim 10, wherein, for discharge of an ink drop from said first head section, said second voltage is a pulse voltage to be applied after an applied first voltage.

12. An inkjet printer as claimed in claim 11, wherein, for discharge of an ink drop from said first head section, said second voltage is applied after a lapse of at least 20 $\mu$s after an applied first voltage.

13. An inkjet printer as claimed in claim 10, wherein, for discharge of an ink drop from said first head section, said first voltage is provided by a main pulse, and said second voltage is provided by a sub-pulse applied after an applied main pulse.

14. An inkjet printer as claimed in claim 13, wherein said sub-pulse has a small voltage value which does not induce an ink discharge.

15. An inkjet printer as claimed in claim 13, wherein said sub-pulse has a voltage value based on a size of an ink drop discharged by the main pulse.

16. An inkjet printer as claimed in claim 13, wherein a time required for a fall of said main pulse is longer than a time required for a rise of said main pulse.

17. An inkjet printer as claimed in claim 13, wherein a time required for a fall of said main pulse is at least equal to one half of a natural vibration cycle of ink in one of said first head section and said second head section.

18. An inkjet printer as claimed in claim 10, wherein said first head section discharges large ink drops to form large-diameter printed ink dots, and said second head section discharges small ink drops to form small-diameter printed ink dots.

19. An inkjet printer as claimed in claim 18, wherein said controller prevents application of said second voltage to said second head section.

20. An inkjet printer as claimed in claim 19, wherein a period between initiation of said first voltage applied to said first head section and initiation of said second voltage applied to said first head section is less than a duration of a first pulse applied to said second head section.

21. An inkjet printer as claimed in claim 10, wherein, for discharge of an ink drop from said first head section, said second voltage is applied as a continuation of an applied first voltage, and said second voltage value gradually decreases over a prescribed time.

22. An inkjet printer as claimed in claim 1, wherein an applied primary voltage and an applied secondary voltage have a same polarity.

23. A method for discharging an ink drop in an inkjet printer having a printing head including an ink channel for storing ink, a nozzle in fluid communication with said ink channel, and a piezoelectric element corresponding with said ink channel to effect a discharge of ink through said nozzle, said method comprising the steps of:

applying a first voltage to said printing head to discharge an ink drop from said printing head; and for a discharged ink drop having at least a prescribed size, applying a second voltage to said printing head to reduce post-discharge vibration in at least a portion of ink stored in said printing head due to said step of applying said first voltage.

24. A method as claimed in claim 23, wherein said second voltage is a pulse voltage to be applied after application of said first voltage.

25. A method as claimed in claim 24, wherein said second voltage is applied after a lapse of at least 20 $\mu$s after the application of said first voltage.

26. A method as claimed in claim 23, wherein said first voltage is provided by a main pulses, and said second voltage is provided by a sub-pulse applied after the application of the main pulse.

27. A method as claimed in claim 26, wherein a time required for a fall of said main pulse is longer than a time required for a rise of said main pulse.

28. A method as claimed in claim 26, wherein a time required for a fall of said main pulse is at least equal to one-half of a natural vibration cycle of ink in said ink cavity.

29. A method as claimed in claim 26, wherein said sub-pulse has a small voltage value which does not induce an ink discharge.

30. A method as claimed in claim 26, wherein said sub-pulse has a voltage value based on a size of an ink drop discharged by the main pulse.

31. A method as claimed in claim 23, wherein said second voltage is applied as a continuation of said first voltages and said second voltage value gradually decreases over a prescribed time.

32. A method as claimed in claim 23, wherein said printing head includes a first head section and a second head section, wherein each of said first head section and said second head section includes an ink channel for storing ink, a nozzle in fluid communication with said ink channel, and a piezoelectric element corresponding with said ink channel to effect a discharge of ink through said nozzle, wherein said first head section discharges a large-diameter ink drop, and said second head section discharges a small-diameter ink drop.

33. A method as claimed in claim 32, wherein a period between initiation of said first voltage applied to said first head sect-on and initiation of said second voltage applied to said first head section is less than a duration of a first pulse applied to said second head section.

* * * * *